US011502420B2

(12) United States Patent
Li

(10) Patent No.: US 11,502,420 B2
(45) Date of Patent: Nov. 15, 2022

(54) TWIN LINE FED DIPOLE ARRAY ANTENNA

(71) Applicant: Aptiv Technologies Limited, St. Michael (BB)

(72) Inventor: Mingjian Li, Santa Clara, CA (US)

(73) Assignee: Aptiv Technologies Limited, St. Michael (BB)

( * ) Notice: Subject to any disclaimer, the term of this patent is extended or adjusted under 35 U.S.C. 154(b) by 1 day.

(21) Appl. No.: 17/234,337

(22) Filed: Apr. 19, 2021

(65) Prior Publication Data

US 2022/0200163 A1 Jun. 23, 2022

Related U.S. Application Data

(60) Provisional application No. 63/169,093, filed on Mar. 31, 2021, provisional application No. 63/127,873, filed on Dec. 18, 2020.

(51) Int. Cl.
*H01Q 21/00* (2006.01)
*H01Q 21/06* (2006.01)
(Continued)

(52) U.S. Cl.
CPC ..... *H01Q 21/062* (2013.01); *H01Q 1/247* (2013.01); *H01Q 1/3233* (2013.01); *H01Q 9/285* (2013.01);
(Continued)

(58) Field of Classification Search
CPC ..... H01Q 1/3233; H01Q 13/18; H01Q 5/371; H01Q 9/16; H01Q 9/26; H01Q 9/285
See application file for complete search history.

(56) References Cited

U.S. PATENT DOCUMENTS 3,462,713 A 8/1969 Knerr
3,579,149 A 5/1971 Ramsey
(Continued)

FOREIGN PATENT DOCUMENTS

CA 2654470 A1 12/2007
CN 1620738 5/2005
(Continued)

OTHER PUBLICATIONS

"Extended European Search Report", EP Application No. 18153137.7, dated Jun. 15, 2018, 8 pages.
(Continued)

*Primary Examiner* — Daniel Munoz
(74) *Attorney, Agent, or Firm* — Sawtooth Patent Group PLLC

(57) ABSTRACT

This document describes a twin line fed dipole array antenna that may be coupled to several different types of feed networks in a space-efficient manner. The antenna makes use of a twin line feed to a plurality of dipoles that minimizes cross-polarization. The antenna may be manufactured on a printed circuit board (PCB) and has a centered feed slot that is easily coupled to several different types of waveguides or a microstrip. In some implementations, the dipole elements may have an approximately rectangular shape. In other implementations, the dipole elements may have an approximately bowtie shape, round shape, oval shape, C-shape, or L-shape. The size and placement of the dipole elements may be optimized for certain operating frequencies of the radar system to which the antenna is coupled.

20 Claims, 8 Drawing Sheets

(51) Int. Cl.

| | |
|---|---|
| ***H01Q 1/24*** | (2006.01) |
| ***H01Q 1/32*** | (2006.01) |
| ***H01Q 9/28*** | (2006.01) |
| ***H01Q 19/02*** | (2006.01) |

(52) U.S. Cl.

CPC ..... *H01Q 19/028* (2013.01); *H01Q 21/0037* (2013.01)

(56) References Cited

U.S. PATENT DOCUMENTS

| | | | |
|---|---|---|---|
| 4,157,516 | A | 6/1979 | Van De Grijp |
| 4,453,142 | A | 6/1984 | Murphy |
| 4,562,416 | A | 12/1985 | Sedivec |
| 4,590,480 | A | 5/1986 | Nikolayuk et al. |
| 5,982,256 | A | 11/1999 | Uchimura et al. |
| 5,986,527 | A | 11/1999 | Ishikawa et al. |
| 6,489,855 | B1 | 12/2002 | Kitamori et al. |
| 6,794,950 | B2 | 9/2004 | Du Tolt et al. |
| 6,867,660 | B2 | 3/2005 | Kitamori et al. |
| 6,958,662 | B1 | 10/2005 | Salmela et al. |
| 7,973,616 | B2 | 7/2011 | Shijo et al. |
| 7,994,879 | B2 | 8/2011 | Kim et al. |
| 8,013,694 | B2 | 9/2011 | Hiramatsu et al. |
| 8,089,327 | B2 | 1/2012 | Margomenos et al. |
| 8,159,316 | B2 | 4/2012 | Miyazato et al. |
| 8,692,731 | B2 | 4/2014 | Lee et al. |
| 9,007,269 | B2 | 4/2015 | Lee et al. |
| 9,450,281 | B2 | 9/2016 | Kim |
| 9,673,532 | B2 | 6/2017 | Cheng et al. |
| 9,935,065 | B1 | 4/2018 | Baheti et al. |
| 10,283,832 | B1 * | 5/2019 | Chayat ..... H01Q 9/0407 |
| 10,468,736 | B2 | 11/2019 | Mangaiahgari |
| 10,775,573 | B1 | 9/2020 | Hsu et al. |
| 10,833,385 | B2 | 11/2020 | Mangaiahgari et al. |
| 2002/0021197 | A1 | 2/2002 | Elco |
| 2004/0069984 | A1 | 4/2004 | Estes et al. |
| 2006/0113598 | A1 | 6/2006 | Chen et al. |
| 2008/0129409 | A1 | 6/2008 | Nagaishi et al. |
| 2008/0150821 | A1 | 6/2008 | Koch et al. |
| 2009/0207090 | A1 | 8/2009 | Pettus et al. |
| 2009/0243762 | A1 | 10/2009 | Chen et al. |
| 2012/0013421 | A1 | 1/2012 | Hayata |
| 2012/0050125 | A1 | 3/2012 | Leiba et al. |
| 2012/0068316 | A1 | 3/2012 | Ligander |
| 2012/0163811 | A1 | 6/2012 | Doany et al. |
| 2012/0242421 | A1 | 9/2012 | Robin et al. |
| 2012/0256796 | A1 | 10/2012 | Leiba |
| 2013/0057358 | A1 | 3/2013 | Anthony et al. |
| 2014/0015709 | A1 | 1/2014 | Shijo et al. |
| 2014/0091884 | A1 | 4/2014 | Flatters |
| 2014/0106684 | A1 | 4/2014 | Burns et al. |
| 2015/0097633 | A1 | 4/2015 | Devries et al. |
| 2015/0229017 | A1 | 8/2015 | Suzuki et al. |
| 2015/0357698 | A1 | 12/2015 | Kushta |
| 2015/0364804 | A1 | 12/2015 | Tong et al. |
| 2015/0364830 | A1 | 12/2015 | Tong et al. |
| 2016/0043455 | A1 | 2/2016 | Seler et al. |
| 2016/0049714 | A1 | 2/2016 | Ligander et al. |
| 2016/0118705 | A1 | 4/2016 | Tang et al. |
| 2016/0126637 | A1 | 5/2016 | Uemichi |
| 2016/0204495 | A1 | 7/2016 | Takeda et al. |
| 2016/0276727 | A1 | 9/2016 | Dang et al. |
| 2016/0293557 | A1 | 10/2016 | Topak et al. |
| 2016/0301125 | A1 | 10/2016 | Kim et al. |
| 2017/0084554 | A1 | 3/2017 | Dogiamis et al. |
| 2017/0324135 | A1 | 11/2017 | Blech et al. |
| 2018/0131084 | A1 | 5/2018 | Park et al. |
| 2018/0226709 | A1 | 8/2018 | Mangaiahgari |
| 2018/0233465 | A1 | 8/2018 | Spella et al. |
| 2018/0284186 | A1 | 10/2018 | Chadha et al. |
| 2018/0301819 | A1 | 10/2018 | Kirino et al. |
| 2018/0343711 | A1 | 11/2018 | Wixforth et al. |
| 2018/0351261 | A1 | 12/2018 | Kamo et al. |
| 2019/0006743 | A1 | 1/2019 | Kirino et al. |
| 2019/0013563 | A1 | 1/2019 | Takeda et al. |
| 2019/0245276 | A1 | 8/2019 | Li et al. |
| 2019/0252778 | A1 * | 8/2019 | Duan ..... H01Q 1/521 |
| 2020/0021001 | A1 | 1/2020 | Mangaiahgairi |
| 2020/0235453 | A1 | 7/2020 | Lang |
| 2020/0343612 | A1 | 10/2020 | Shi |
| 2021/0036393 | A1 | 2/2021 | Mangaiahgari |

FOREIGN PATENT DOCUMENTS

| | | | |
|---|---|---|---|
| CN | 2796131 | | 7/2006 |
| CN | 201383535 | | 1/2010 |
| CN | 102157787 | A | 8/2011 |
| CN | 102420352 | A | 4/2012 |
| CN | 103515682 | A | 1/2014 |
| CN | 104900956 | | 9/2015 |
| CN | 105609909 | A | 5/2016 |
| CN | 105680133 | A | 6/2016 |
| CN | 105958167 | A | 9/2016 |
| CN | 109980361 | A | 7/2019 |
| CN | 209389219 | U | 9/2019 |
| DE | 112017006415 | | 9/2019 |
| DE | 102019200893 | | 7/2020 |
| EP | 2500978 | | 9/2012 |
| EP | 2843758 | | 3/2015 |
| EP | 3460903 | | 3/2019 |
| GB | 2489950 | | 10/2012 |
| JP | 2003289201 | | 10/2003 |
| JP | 2013187752 | A | 9/2013 |
| KR | 100846872 | | 5/2008 |
| KR | 1020080044752 | A | 5/2008 |
| WO | 2013189513 | | 12/2013 |
| WO | 2018003932 | | 1/2018 |

OTHER PUBLICATIONS

"Extended European Search Report", EP Application No. 20166797, dated Sep. 16, 2020, 11 pages.

"Foreign Office Action", CN Application No. 201810122408.4, dated Jun. 2, 2021, 15 pages.

"Non-Final Office Action", U.S. Appl. No. 16/583,867, dated Feb. 18, 2020, 8 pages.

"Non-Final Office Action", U.S. Appl. No. 15/427,769, dated Nov. 13, 2018, 8 pages.

"Notice of Allowance", U.S. Appl. No. 15/427,769, dated Jun. 28, 2019, 9 pages.

"Notice of Allowance", U.S. Appl. No. 16/583,867, dated Jul. 8, 2020, 8 Pages.

Jankovic, et al., "Stepped Bend Substrate Integrated Waveguide to Rectangular Waveguide Transitions", Jun. 2016, 2 pages.

"Extended European Search Report", EP Application No. 21211165.2, dated May 13, 2022, 12 pages.

"Extended European Search Report", EP Application No. 21211167.8, dated May 19, 2022, 10 pages.

"Extended European Search Report", EP Application No. 21211168.6, dated May 13, 2022, 11 pages.

"Extended European Search Report", EP Application No. 21211452.4, dated May 16, 2022, 10 pages.

"Extended European Search Report", EP Application No. 21211478.9, dated May 19, 2022, 10 pages.

"Foreign Office Action", CN Application No. 201810122408.4, dated Oct. 18, 2021, 19 pages.

Alhuwaimel, et al., "Performance Enhancement of a Slotted Waveguide Antenna by Utilizing Parasitic Elements", Sep. 7, 2015, pp. 1303-1306.

Li, et al., "Millimetre-wave slotted array antenna based on double-layer substrate integrated waveguide", Jun. 1, 2015, pp. 882-888.

Mak, et al., "A Magnetoelectric Dipole Leaky-Wave Antenna for Millimeter-Wave Application", Dec. 12, 2017, pp. 6395-6402.

Mallahzadeh, et al., "A Low Cross-Polarization Slotted Ridged SIW Array Antenna Design With Mutual Coupling Considerations", Jul. 17, 2015, pp. 4324-4333.

Rossello, et al., "Substrate Integrated Waveguide Aperture Coupled Patch Antenna Array for 24 GHz Wireless Backhaul and Radar Applications", Nov. 16, 2014, 2 pages.

(56) References Cited

OTHER PUBLICATIONS

Shehab, et al., "Substrate-Integrated-Waveguide Power Dividers", Oct. 15, 2019, pp. 27-38.
Wang, et al., "Mechanical and Dielectric Strength of Laminated Epoxy Dielectric Graded Materials", Mar. 2020, 15 pages.
Wu, et al., "A Planar W-Band Large-Scale High-Gain Substrate-Integrated Waveguide Slot Array", Feb. 3, 2020, pp. 6429-6434.
Xu, et al., "CPW Center-Fed Single-Layer SIW Slot Antenna Array for Automotive Radars", Jun. 12, 2014, pp. 4528-4536.

* cited by examiner

TWIN LINE FED DIPOLE ARRAY ANTENNA

CROSS-REFERENCE TO RELATED APPLICATIONS

This application claims the benefit under 35 U.S.C. 119(e) of U.S. Provisional Application No. 63/169,093, filed Mar. 31, 2021, and U.S. Provisional Application No. 63/127,873, filed Dec. 18, 2020, the disclosures of which are hereby incorporated by reference in their entirety herein.

BACKGROUND

Some devices (e.g., radar systems) use electromagnetic signals to detect and track objects. The electromagnetic signals are transmitted and received using one or more antennas. The radiation pattern of an antenna may be characterized by gain or beam width, which indicates gain as a function of direction. Precisely controlling the radiation pattern can focus a radar system (e.g., a narrow beam width, an ultra-wide beam) to detect objects within a particular field-of-view (e.g., in a travel path of the vehicle). Antennas and waveguides can improve and control the radiation pattern, but some antennas have drawbacks, such as a high cross-polarization level that may adversely affect a desired gain or beam width. An input feed to these antennas is often a thin conductor or "microstrip line" that can be difficult to install, particularly when coupling to a waveguide-type feed network or a waveguide-type routing line.

SUMMARY

This document describes techniques, apparatuses, and systems for a twin line fed dipole array antenna. An apparatus may include an antenna capable of being fed by different types of inputs. The antenna includes a transmission line configured to receive electromagnetic energy as input. The transmission line may have a lateral axis, a first branch, and a second branch. Each branch may have two parallel arms. The first branch may be orthogonal to and positioned on one side of the lateral axis, and the second branch may be orthogonal to and positioned on the opposite side of the lateral axis from the first branch. The antenna may be configured to have a low cross-polarization level.

This document also describes methods performed by the above-summarized techniques, apparatuses, and systems, and other methods set forth herein, as well as means for performing these methods.

This Summary introduces simplified concepts related to a twin line fed dipole array antenna, further described in the Detailed Description and Drawings. This Summary is not intended to identify essential features of the claimed subject matter, nor is it intended for use in determining the scope of the claimed subject matter.

BRIEF DESCRIPTION OF THE DRAWINGS

The details of one or more aspects of a twin line fed dipole array antenna are described in this document with reference to the following figures. The same numbers are often used throughout the drawings to reference like features and components:

FIG. 2-1 illustrates a top view of a twin line fed dipole array antenna;

FIG. 2-2 illustrates a cross-section view of a twin line fed dipole array antenna;

DETAILED DESCRIPTION

Overview

Radar systems are a sensing technology that some automotive systems rely on to acquire information about the surrounding environment. Radar systems generally use an antenna to direct electromagnetic energy or signals being transmitted or received. Such radar systems may use any combination of antennas and waveguides to provide increased gain and directivity. However, many antennas are not designed to be coupled to a waveguide feed network, particularly in a manner that minimizes the form factor needed to house the antenna and accompanying feed network. Additionally, the antennas tend to have a larger cross-polarization level than desired. Large cross-polarization levels may produce undesired grating lobes in a radiation pattern of an antenna system. These undesired grating lobes can reduce the accuracy of object detection.

This document describes a twin line fed dipole array antenna that may be coupled to several different types of feed networks in a space-efficient manner. The antenna makes use of a twin line feed to a plurality of dipoles that minimizes cross-polarization. The antenna may be manufactured on a printed circuit board (PCB) and has a centered feed slot that is easily coupled to several different types of waveguides or a microstrip. In some implementations, the dipole elements may have an approximately rectangular shape. In other implementations, the dipole elements may have an approximately bowtie shape, round shape, oval shape, C-shape, or L-shape. The size and placement of the dipole elements may be optimized for certain operating frequencies of the radar system to which the antenna is coupled.

The described antenna may be particularly advantageous for use in an automotive context, for example, detecting objects in a roadway in a travel path of a vehicle. The low cross-polarization level allows a radar system of the vehicle to detect objects in a particular field-of-view (e g, immediately in front of the vehicle) in an efficient manner. As one example, a radar system may transmit and receive a stronger signal (e.g., a co-polarized signal) with the described antenna enabling the radar system to generate more-accurate radar tracks compared to a different type of antenna.

This example antenna is just one example of the described techniques, apparatuses, and systems of a twin line fed dipole array antenna. This document describes other examples and implementations.

Operating Environment

Figure 1:
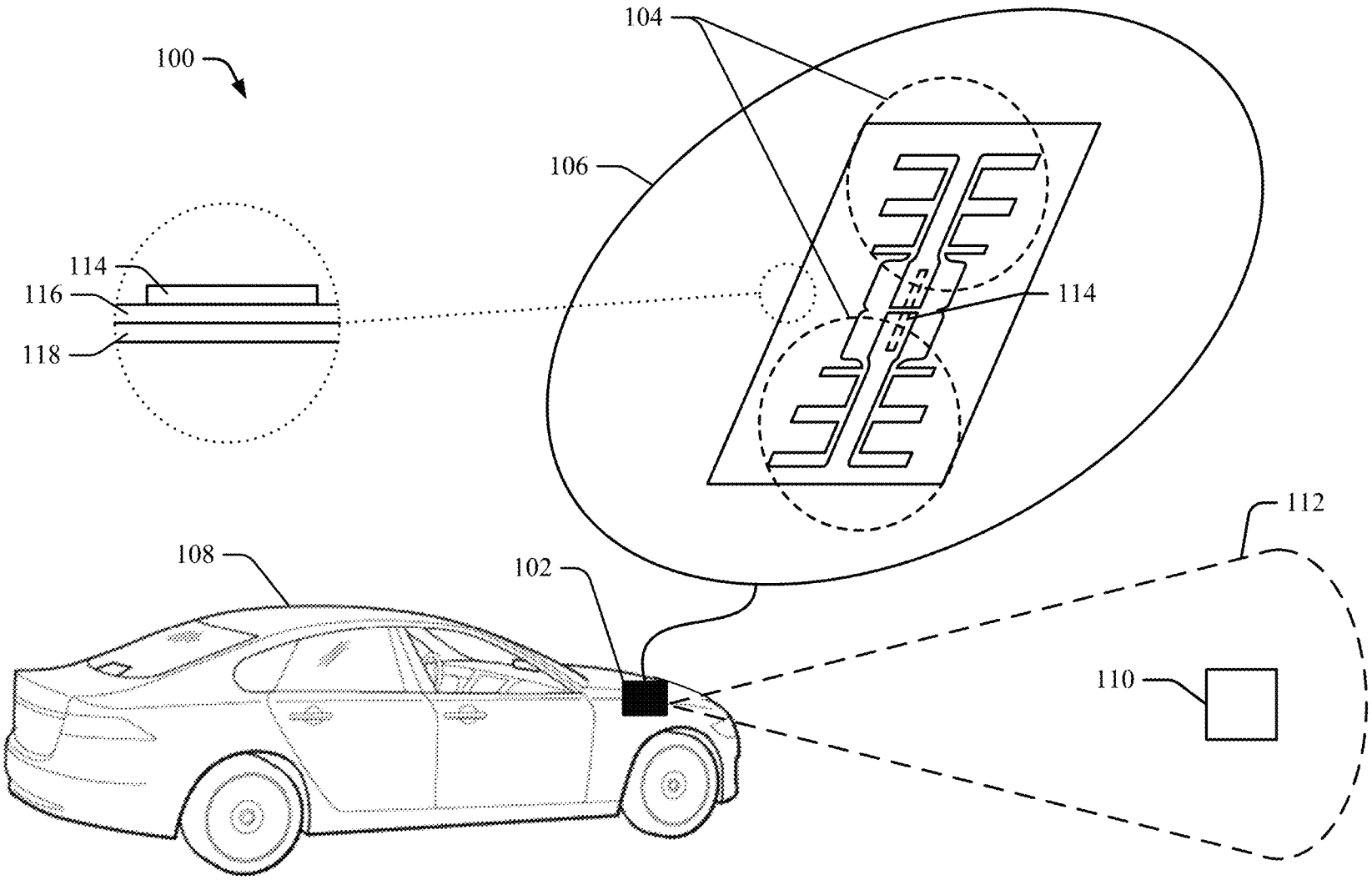
FIG. 1 illustrates an example environment in which a radar system with a twin line fed dipole array antenna is used on a vehicle.

FIG. 1 illustrates an example environment 100 in which a radar system 102 with a twin line fed dipole array 104 antenna 106 is used on a vehicle 108. The vehicle 108 may use the antenna 106 to enable operations of the radar system 102 that is configured to determine a proximity, an angle, or a velocity of one or more objects 110 in the proximity of the vehicle 108.

Although illustrated as a car, the vehicle 108 can represent other types of motorized vehicles (e.g., a motorcycle, a bus, a tractor, a semi-trailer truck, or construction equipment), non-motorized vehicles (e.g., a bicycle), railed vehicles (e.g., a train or a trolley car), watercraft (e.g., a boat or a ship), aircraft (e.g., an airplane or a helicopter), or spacecraft (e.g., satellite). In general, manufacturers can mount the radar system 102 to any moving platform, including moving machinery or robotic equipment. In other implementations, other devices (e.g., desktop computers, tablets, laptops, televisions, computing watches, smartphones, gaming systems, and so forth) may incorporate the radar system 102 with the antenna 106 and support techniques described herein.

In the depicted environment 100, the radar system 102 is mounted near, or integrated within, a front portion of the vehicle 108 to detect the object 110 and avoid collisions. The radar system 102 provides a field-of-view 112 towards the one or more objects 110. The radar system 102 can project the field-of-view 112 from any exterior surface of the vehicle 108. For example, vehicle manufacturers can integrate the radar system 102 into a bumper, side mirror, headlights, rear lights, or any other interior or exterior location where the object 110 requires detection. In some cases, the vehicle 108 includes multiple radar systems 102, such as a first radar system 102 and a second radar system 102 that provide a larger field-of-view 112. In general, vehicle manufacturers can design the locations of the one or more radar systems 102 to provide a particular field-of-view 112 that encompasses a region of interest, including, for instance, in or around a travel lane aligned with a vehicle path.

Example fields-of-view 112 include a 360-degree field-of-view, one or more 180-degree fields-of-view, one or more 90-degree fields-of-view, and so forth, which can overlap or be combined into a field-of-view 112 of a particular size. The described antenna 106 may include a plurality of dipoles 104 (e.g., the dipole array 104) that have a length (e.g., less than one-half wavelength of the operating frequency in free space) and position (e.g., approximately one-half wavelength of the operating frequency in free space from a neighboring dipole) that minimize cross-polarization, resulting in an improved signal strength in the azimuth plane. As one example, a radar system placed near the front of a vehicle can use the improved signal strength to focus on detecting objects immediately in front of the vehicle (e.g., in a travel lane aligned with a vehicle path). The improved signal strength of the antenna may provide increased accuracy when detecting the objects.

The object 110 is composed of one or more materials that reflect radar signals. Depending on the application, the object 110 can represent a target of interest. In some cases, the object 110 can be a moving object or a stationary object. The stationary objects can be continuous (e.g., a concrete barrier, a guard rail) or discontinuous (e.g., a traffic cone) along a road portion.

The radar system 102 emits electromagnetic radiation by transmitting one or more electromagnetic signals or waveforms via dipole arrays 104. In the environment 100, the radar system 102 can detect and track the object 110 by transmitting and receiving one or more radar signals. For example, the radar system 102 can transmit electromagnetic signals between 100 and 400 gigahertz (GHz), between 4 and 100 GHz, or between approximately 70 and 80 GHz.

The radar system 102 can determine a distance to the object 110 based on the time it takes for the signals to travel from the radar system 102 to the object 110 and from the object 110 back to the radar system 102. The radar system 102 can also determine the location of the object 110 in terms of an angle based on the direction of a maximum amplitude echo signal received by the radar system 102.

The radar system 102 can be part of the vehicle 108. The vehicle 108 can also include at least one automotive system that relies on data from the radar system 102, including a driver-assistance system, an autonomous-driving system, or a semi-autonomous-driving system. The radar system 102 can include an interface to the automotive systems. The radar system 102 can output, via the interface, a signal based on electromagnetic energy received by the radar system 102.

Generally, the automotive systems of the vehicle 108 use radar data provided by the radar system 102 to perform a function. For example, a driver-assistance system can provide blind-spot monitoring and generate an alert indicating a potential collision with the object 110 detected by the radar system 102. In this case, the radar data from the radar system 102 indicates when it is safe or unsafe to change lanes. An autonomous-driving system may move the vehicle 108 to a particular location on the road while avoiding collisions with the object 110 detected by the radar system 102. The radar data provided by the radar system 102 can provide information about a distance to and the location of the object 110 to enable the autonomous-driving system to perform emergency braking, perform a lane change, or adjust the speed of the vehicle 108.

The radar system 102 generally includes a transmitter (not illustrated) and at least one antenna 106 to transmit electromagnetic signals. The radar system 102 generally includes a receiver (not illustrated) and at least one antenna 106 to receive reflected versions of these electromagnetic signals. The transmitter includes components for emitting electromagnetic signals. The receiver includes components to detect the reflected electromagnetic signals. The transmitter and the receiver can be incorporated together as a transceiver on the same integrated circuit (e.g., a transceiver integrated circuit) or separately on the same or different integrated circuits.

The radar system 102 also includes one or more processors (not illustrated) and computer-readable storage media (CRM) (not illustrated). The processor can be a microprocessor or a system-on-chip. The processor executes instructions stored within the CRM. As an example, the processor can control the operation of the transmitter. The processor can also process electromagnetic energy received by the antenna 106 and determine the location of the object 110 relative to the radar system 102. The processor can also generate radar data for the automotive systems. For example, the processor can control, based on processed electromagnetic energy from the antenna, an autonomous or semi-autonomous driving system of the vehicle 108.

The antenna 106 can be defined as a first metal layer 114 of a PCB. Other layers of the PCB may include a substrate layer 116 and a second metal layer 118 that defines a conducting plane. A feed slot 114 may be positioned in and centered on the conductive plane and aligned with a lateral axis of the antenna. A microstrip or waveguide feed network can be coupled to the feed slot 114 and can electrically excite the antenna via the feed slot 114. Further, each dipole in the dipole array 104 includes two dipole elements. The electromagnetic energy propagates through each arm of each branch of the antenna 106 and feeds each dipole element of the dipole differentially. In this manner, the antenna 106 is capable of radiating energy at a low cross-polarization level.

Figures 1, 2:
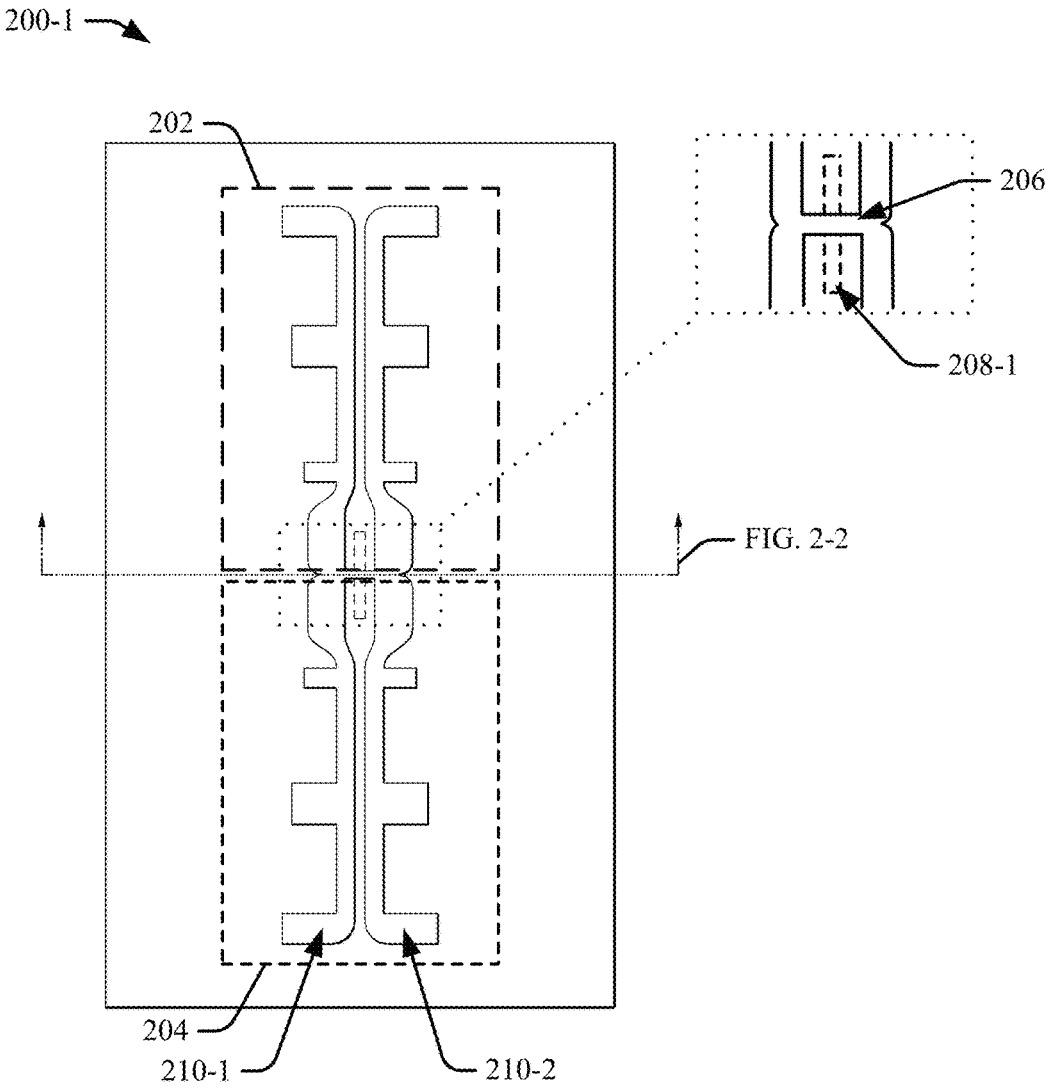
Figure 2:
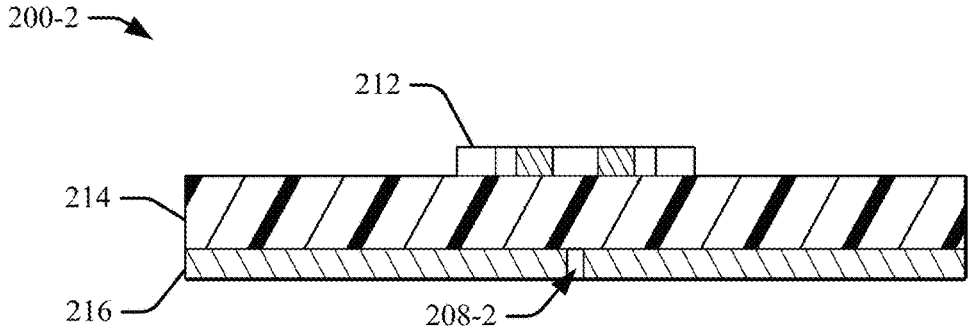

FIG. 2-1 illustrates a top view 200-1 of a twin line fed dipole array antenna 200. The antenna 200 is an example of the antenna 106 of FIG. 1. The antenna 200-1 includes an upper branch 202 and a lower branch 204. The upper branch 202 and the lower branch 204 each have two arms positioned orthogonally to a lateral axis 206. Said differently, the branches 202 and 204 are near perpendicular or normal to the lateral axis 206, which enables the antenna 200 to achieve a desired pattern. A feed slot 208-1 is centered on the lateral axis 206 and couples electromagnetic energy between the antenna 200 and a feed network or feed line. Having the feed slot 208-1 centered on the lateral axis 206 enables a wider variety of connections, especially with different types of waveguides that are more difficult to couple to an end type of feed. Each arm can have one or more dipole elements (e.g., dipole elements 210-1 and 210-2 of dipole 210). Each dipole 210 is sized and positioned to allow for optimal electromagnetic energy transfer.

FIG. 2-2 illustrates a cross-section view 200-2 of the twin line fed dipole array antenna 200. The antenna 200 is illustrated as a PCB in this example. A first metal layer 212 may be the layer on which the antenna 200 structure is located. A substrate layer 214 may separate the first metal layer 212 from a second metal layer 216 that defines a conducting plane. The second metal layer 216 includes a feed slot 208-2 that is positioned in and centered on the conducting plane to align with a lateral axis (e.g., the lateral axis 206). The feed slot 208-2 may be electrically excited by various methods, including the non-limiting examples of a microstrip line couple, a waveguide end, a waveguide, or a substrate integrated waveguide (SIW). The method of exciting the slot may define the type of feed line for the antenna.

Figure 3:
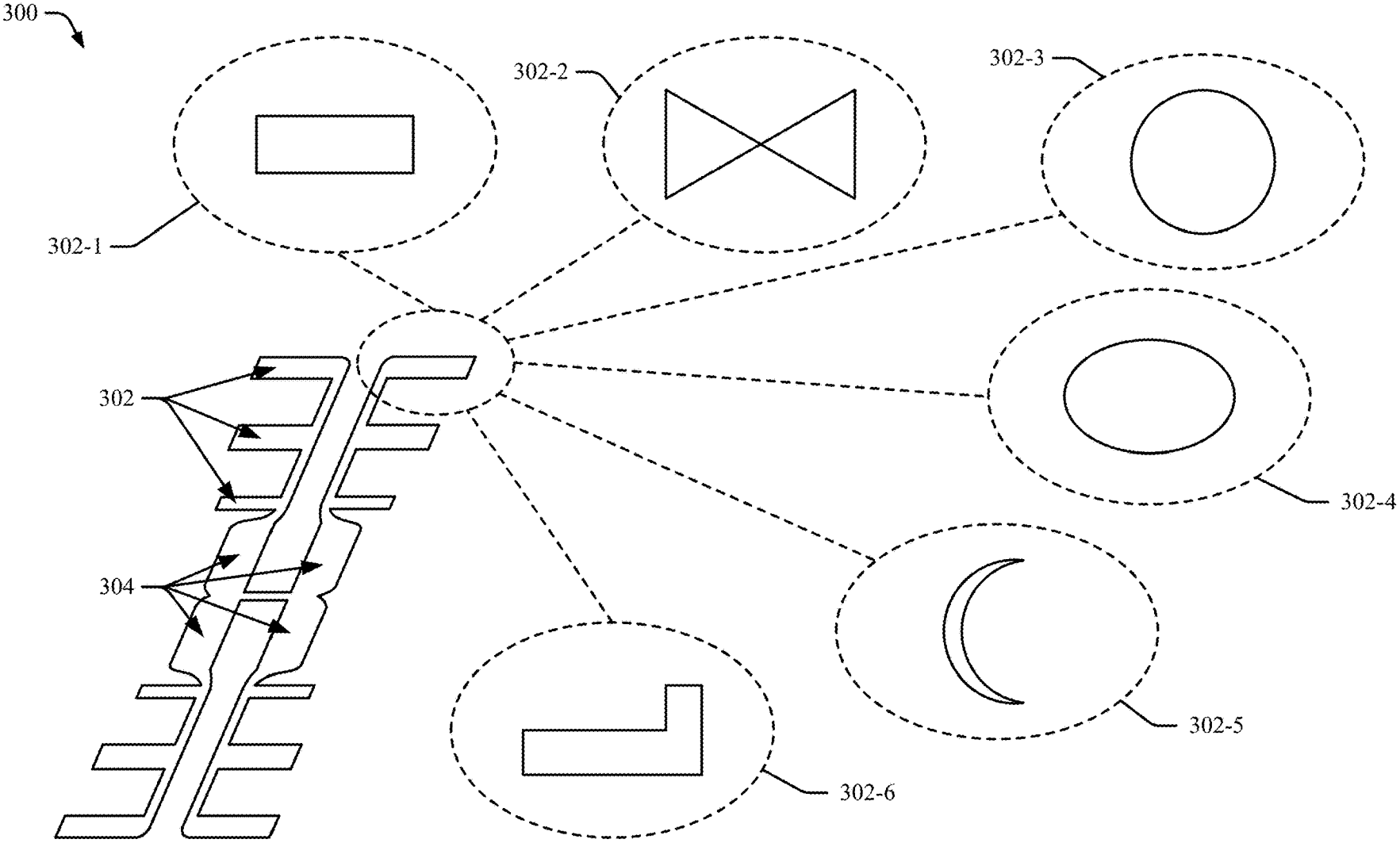
FIG. 3 illustrates different shapes a dipole element may have on a twin line fed dipole array antenna.

FIG. 3 illustrates different shapes a dipole element may have on a twin line fed dipole array antenna 300. The antenna 300 is another example of the antenna 106 of FIG. 1. Each arm 304 of each branch of the antenna 300 includes three dipole elements 302. In other examples, each arm 304 of each branch of the antenna 300 may include a greater or lesser quantity of dipole elements, depending on the size constraints of the antenna 300, and/or depending on the desired antenna pattern. In FIG. 3, the antenna 300 is illustrated with the dipole elements 302 positioned approximately orthogonal to each respective arm 304 and having an approximately rectangular shape 302-1. However, the dipole elements 302 may have other shapes, including a bowtie shape 302-2, a circular shape 302-3, an oval shape 302-4, a C-shape 302-5, or an L-shape 302-6. The shape of the dipole elements 302 may depend on different factors such as the particular application or the specifics of the system (e.g., the radar system 102) with which the antenna 300 is coupled. Each branch of the antenna 300 may be symmetrical with respect to a lateral axis (e.g., the lateral axis 206 from FIG. 2-1). That is, the upper branch and the lower branch (e.g., the upper branch 202 and the lower branch 204 from FIG. 2-1) may mirror each other along the lateral axis.

Example Implementations

FIGS. 4 through 7 illustrate example feeding methods for a twin line fed dipole array antenna. The method used depends on the configuration of the feed network or how the lines connecting the transceiver module to the antenna are routed. Other feeding methods that are not illustrated may, likewise, be used with the twin line fed dipole array antenna.

Figure 4:
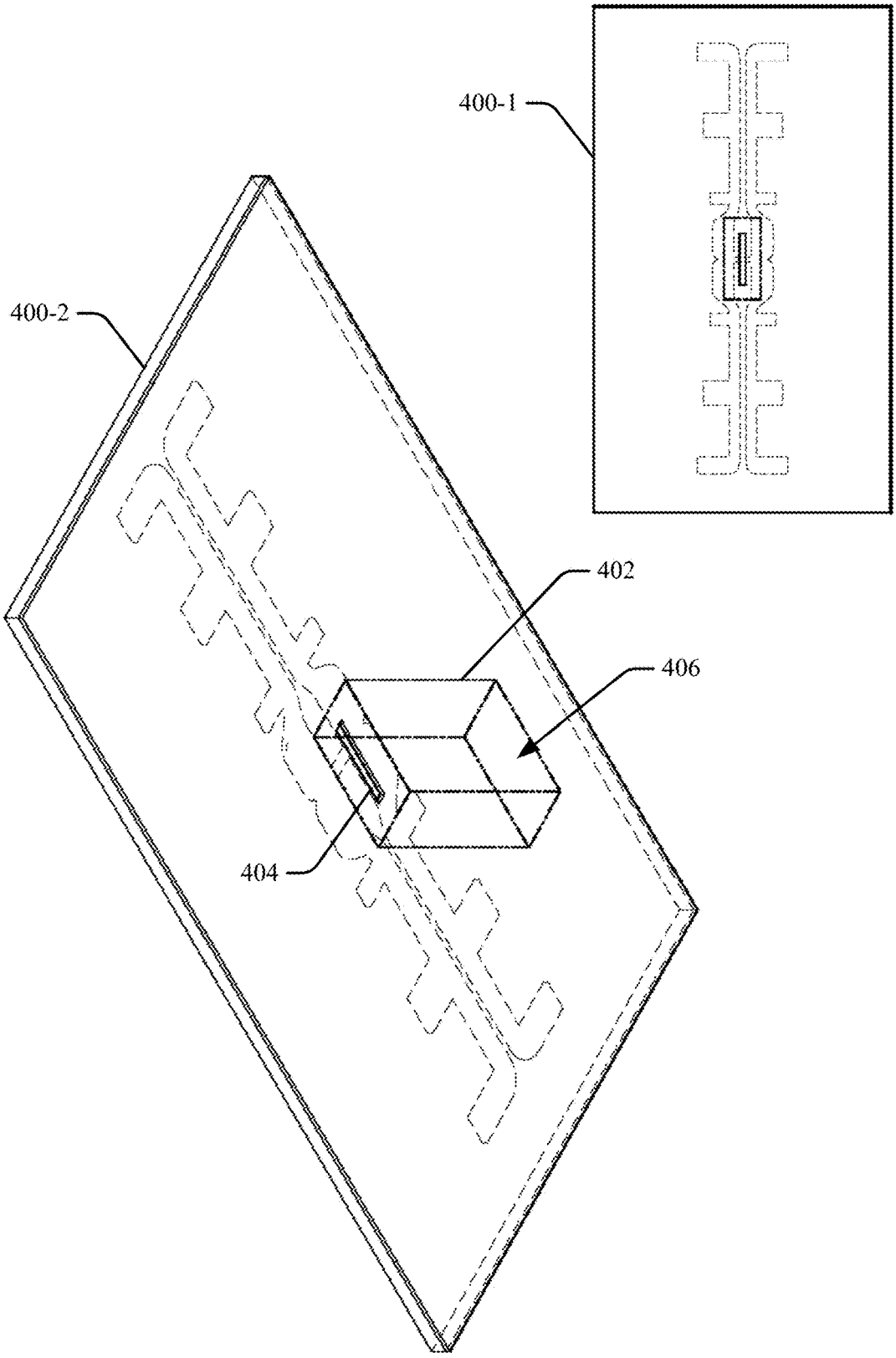
FIG. 4 illustrates an example implementation of a twin line fed dipole array antenna coupled to a waveguide with an end feed.

FIG. 4 illustrates an example implementation of a twin line fed dipole array antenna 400 coupled to a waveguide 402 with an end feed. Two views, a rear view 400-1 and a rear perspective view 400-2 of the antenna 400, are illustrated in FIG. 4 for orientation. The waveguide 402 is coupled to a feed slot 404 (e.g., the feed slot 114, 208) on an end opposite of the waveguide input 406. The coupling can be made via contact, which can be strengthened using electrical coupling means (e.g., solder connection, male-female connectors).

Figure 5:
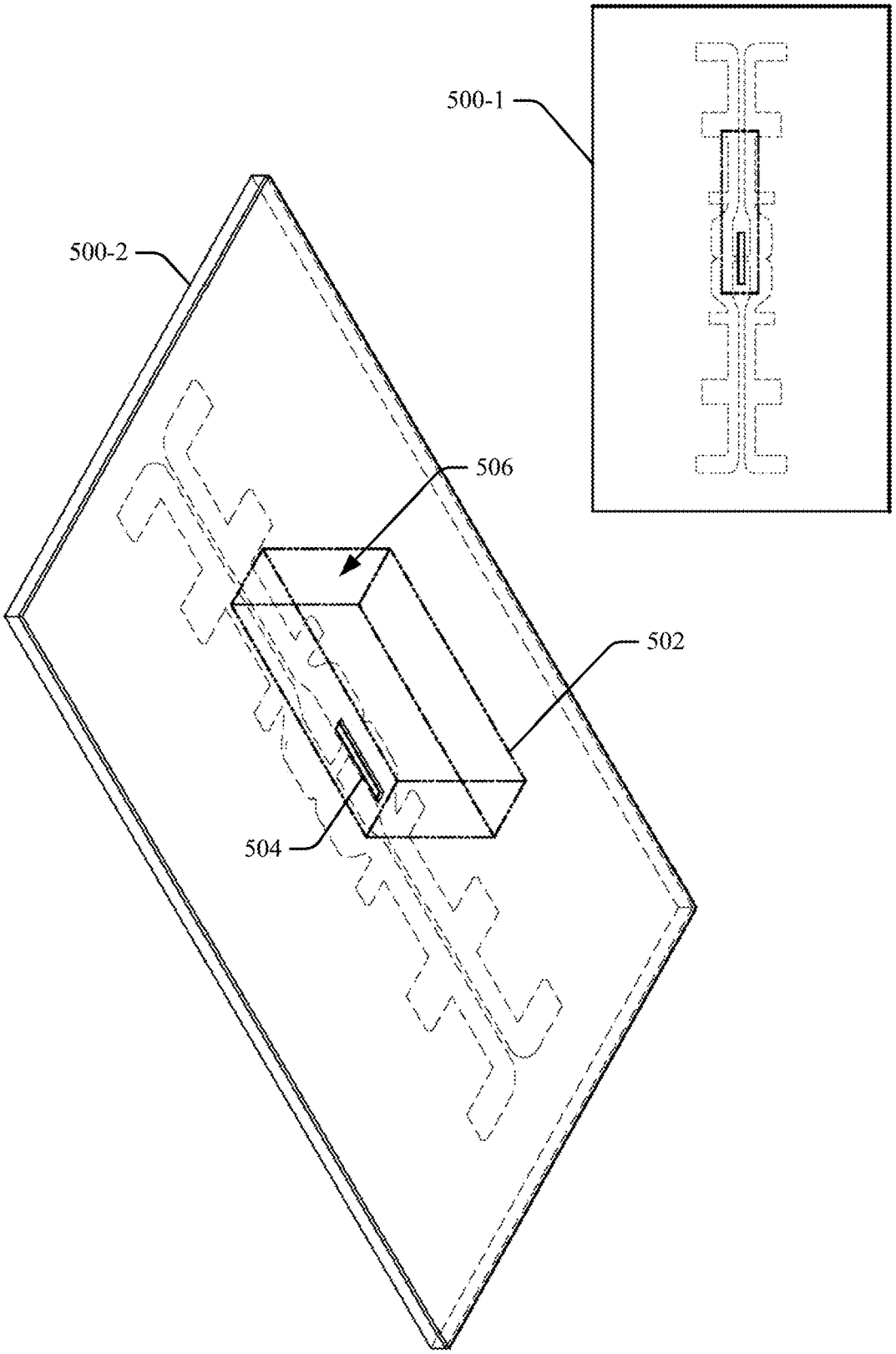
FIG. 5 illustrates an example implementation of a twin line fed dipole array antenna coupled to a waveguide with an E-plane feed.

FIG. 5 illustrates an example implementation of a twin line fed dipole array antenna 500 coupled to a waveguide 502 with an E-plane feed. View 500-1 is a rear view, and view 500-2 is a rear perspective view. In FIG. 5, the waveguide 502 is coupled to a feed slot 504 on the E-plane of the waveguide. A waveguide input 506 is positioned on an end of the waveguide 502 that is longitudinal to the antenna and adjacent to the E-plane feed.

Figure 6:
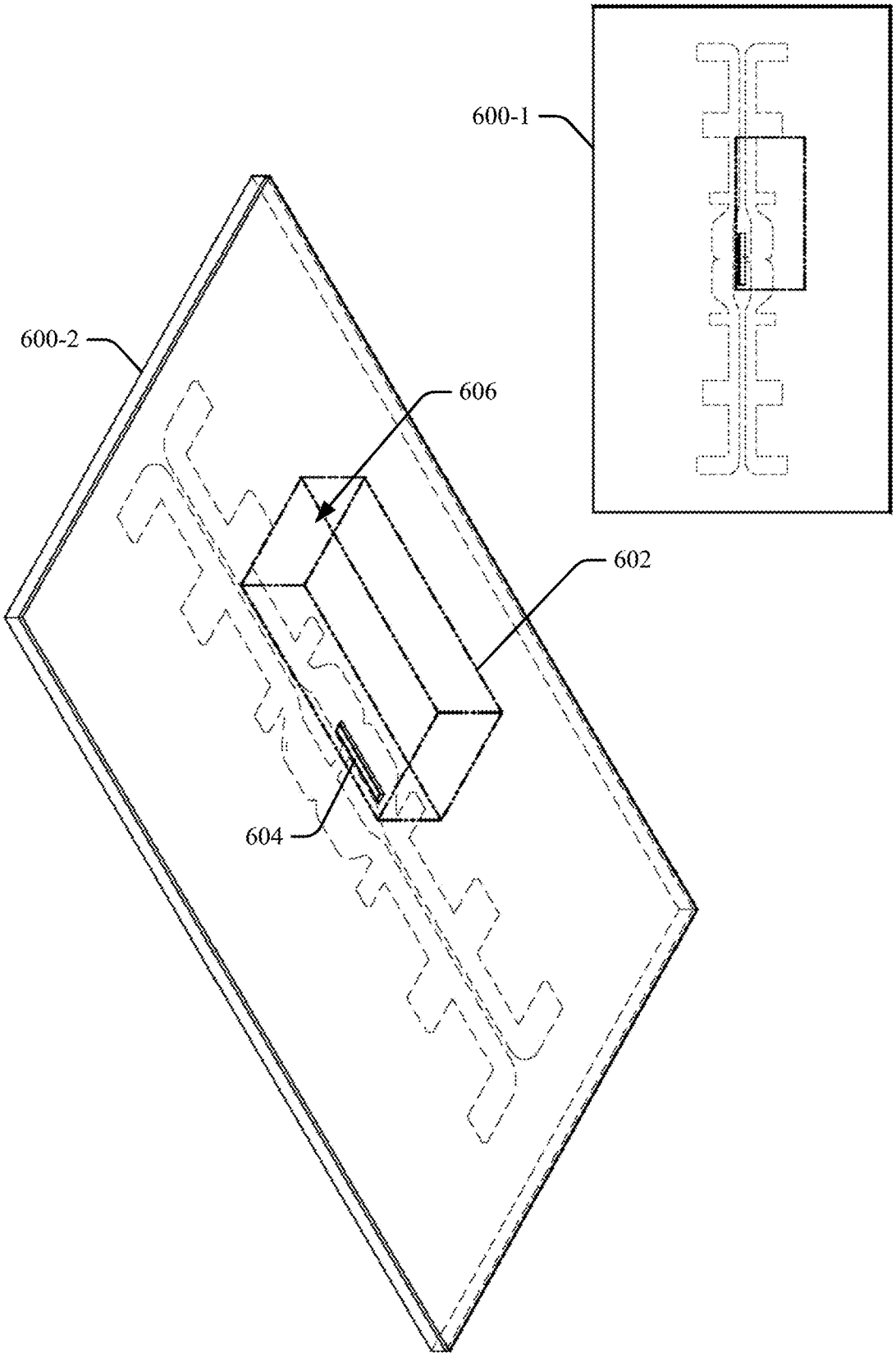
FIG. 6 illustrates an example implementation of a twin line fed dipole array antenna coupled to a waveguide with an H-plane feed.

FIG. 6 illustrates an example implementation of a twin line fed dipole array antenna 600 coupled to a waveguide 602 with an H-plane feed. In the implementation illustrated in FIG. 6, the antenna is coupled to an H-plane waveguide via a feed slot 604. A waveguide input 606 is positioned on an end of the waveguide 602 that is longitudinal to the antenna and adjacent to the H-plane feed.

Figure 7:
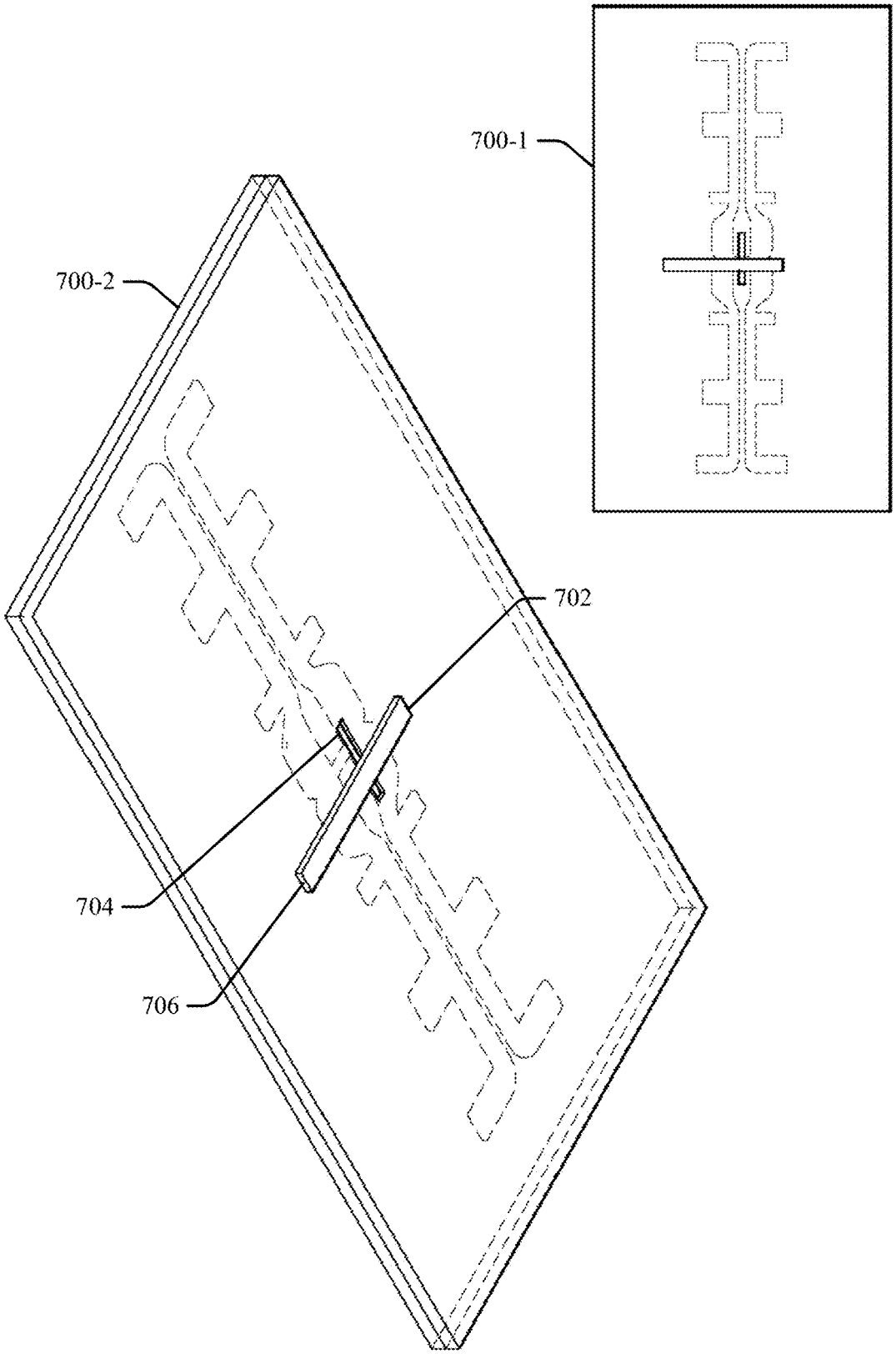
FIG. 7 illustrates an example implementation of a twin line fed dipole array antenna coupled to a microstrip line feed.

FIG. 7 illustrates an example implementation of a twin line fed dipole array antenna 700 coupled to a microstrip 702 line feed. Similar to FIGS. 4-6, FIG. 7 includes a rear view 700-1 and a rear perspective view 700-2 for orientation. The microstrip 702 is coupled to a feed slot 704 by a feed line (not illustrated). The microstrip 702 extends laterally away from the feed slot 704. A microstrip input 706 is located on the lateral extension of the microstrip 702.

Example Method

Figure 8:
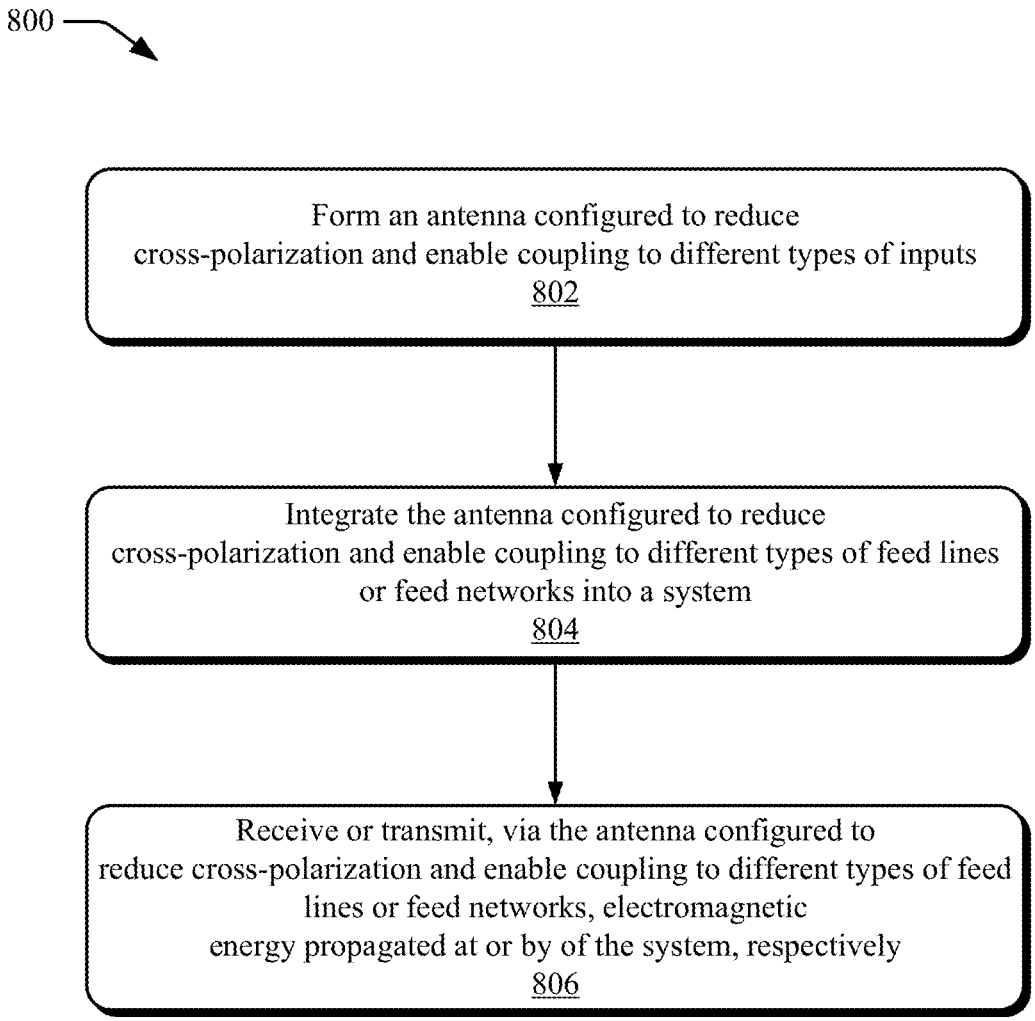
FIG. 8 illustrates an example method that can be used for manufacturing a twin line fed dipole array antenna following techniques, apparatuses, and systems of this disclosure.

FIG. 8 illustrates an example method 800 that can be used for manufacturing a twin line fed dipole array antenna following techniques, apparatuses, and systems of this disclosure. Method 800 is shown as sets of operations (or acts) performed, but not necessarily limited to the order or combinations in which the operations are shown herein. Further, any of one or more of the operations may be repeated, combined, or reorganized to provide other methods. In portions of the following discussion, reference may be made to the environment 100 of FIG. 1 and entities detailed in FIGS. 1 through 7, reference to which is made for example only. The techniques are not limited to performance by one entity or multiple entities.

At 802, a twin line fed dipole array antenna is formed. For example, the antenna 106, 200, 300, 400, 500, 600, and/or 700 can be stamped, etched, cut, machined, cast, molded, or formed in some other way.

At 804, the antenna is integrated into a system. For example, the antenna 106, 200, 300, 400, 500, 600, and/or 700 is electrically coupled to a feed line or feed network that may include one or more of different types of components, including different types of waveguides or microstrip.

At 806, electromagnetic signals are received or transmitted via the antenna at or by the system, respectively. For example, the antenna 106 receives or transmits signals routed through the radar system 102.

As a first example, a twin line fed dipole array antenna is formed as an outer layer of a PCB. Other layers of the PCB include an inner substrate layer and a conducting plane layer on the side of the inner substrate layer opposite of the antenna layer. The conducting plane layer includes a feed slot positioned such that a lateral axis of the antenna layer is centered on it. The antenna has an upper branch and a lower branch that mirror each other along a lateral axis. Each branch includes two arms parallel to each other and extending orthogonally from the lateral axis. The two parallel arms of each branch include a plurality of dipoles with the dipole elements of each of the plurality of dipoles extending orthogonally from the two parallel arms of each branch.

In this example, the twin line fed dipole array antenna is part of a radar system integrated in an autonomous vehicle. The radar system assists the self-driving of the autonomous vehicle by identifying and tracking objects in the vicinity of the autonomous vehicle. Accuracy in tracking the objects is critical to avoiding collisions. The antenna, positioned at the front of the autonomous vehicle, is coupled to the radar system through a feed network that includes a waveguide with an end feed.

Electromagnetic signals, transmitted by the antenna, reflected off an object, and then received by the antenna, enable the radar system to track the object. The autonomous vehicle is able to avoid a collision with the object due to the accuracy provided by the antenna system.

A second example has the same type of twin line fed dipole array antenna as the first example, and is, likewise, mounted in an autonomous vehicle as part of a radar system. However, in this example the feed network between the antenna and the radar system includes a microstrip line. Due to the versatility provided by the centrally positioned feed slot. The antenna is capable of being coupled to the microstrip. Other similar examples may include the antenna being coupled to the feed network through other types of waveguides or connections.

A twin line fed dipole array antenna, as described in this document, may increase the accuracy of the system to which it is coupled by reducing the cross-polarization levels. Due to the feed slot being centrally positioned with respect to the antenna (e.g., centered on a lateral axis of the antenna), the antenna may be coupled to different types of feed networks in a manner that minimizes a form factor of a housing of the antenna and feed network. This makes the twin line fed dipole array antenna a desirable candidate for automotive radar system applications.

Examples

In the following section, examples are provided.

Example 1: An apparatus comprising: a twin line fed dipole array antenna, the antenna comprising: a first metal layer defining a transmission line configured to receive electromagnetic energy as input, the transmission line having a lateral axis and at least: a first branch comprising a first arm and a second arm parallel to the first arm, each of the first arm and the second arm being orthogonal to and positioned on a first side of the lateral axis; and a second branch comprising a third arm and a fourth arm parallel to the third arm, each of the third arm and the fourth arm being orthogonal to and positioned on a second side of the lateral axis that is opposite the first side of the lateral axis.

Example 2: The apparatus of Example 1, the apparatus further comprising: a second metal layer defining a conductive plane; and a substrate layer having two sides of the substrate layer, the first metal layer positioned adjacent to a first side of the substrate layer and the second metal layer positioned adjacent to a second side of the substrate layer.

Example 3: The apparatus of Example 2, wherein the first metal layer, the second metal layer, and the substrate layer are layers of a printed circuit board.

Example 4: The apparatus of Example 2, the apparatus further comprising: a feed slot positioned in and centered on the conductive plane to align with the lateral axis, the feed slot configured to excite the transmission line.

Example 5: The feed slot of Example 4, the feed slot being excited by a microstrip line, a waveguide end, a waveguide, or a substrate integrated waveguide.

Example 6: The apparatus of Example 1, wherein: the first branch further comprises a first pair of dipole elements, a first dipole element of the first pair of dipole elements positioned at an end of and generally orthogonal to the first arm of the first branch, and a second dipole element of the first pair of dipole elements positioned at an end of and generally orthogonal to the second arm of the first branch.

Example 7: The apparatus of Example 6, wherein: the second branch further comprises a second pair of dipole elements, a first dipole element of the second pair of dipole elements positioned at an end of and generally orthogonal to the third arm of the second branch, and a second dipole element of the second pair of dipole elements positioned at an end of and generally orthogonal to the fourth arm of the second branch.

Example 8: The apparatus of Example 7, wherein: the first branch further comprises a plurality of pairs of dipole elements, each pair of dipole elements on the first branch separated from another pair of dipole elements on the first branch by approximately one-half of a wavelength of an operating frequency of the antenna.

Example 9: The apparatus of Example 8, wherein: the second branch further comprises a plurality of pairs of dipole elements, each pair of dipole elements on the second branch separated from another pair of dipole elements on the second branch by approximately one-half of the wavelength of the operating frequency of the antenna.

Example 10: The antenna of Example 9, wherein: each dipole element of the plurality of pairs of dipole elements extends generally orthogonal to the arms and has an approximately rectangular shape, bowtie shape, circular shape, oval shape, C shape, or L shape.

Example 11: A system comprising: an antenna, the antenna comprising: a first metal layer defining a transmission line configured to receive electromagnetic energy as input, the transmission line having a lateral axis and at least: a first branch comprising a first arm and a second arm parallel to the first arm, each of the first arm and the second arm being orthogonal to and positioned on a first side of the lateral axis; and a second branch comprising a third arm and a fourth arm parallel to the third arm, each of the third arm and the fourth arm being orthogonal to and positioned on a second side of the lateral axis that is opposite the first side of the lateral axis; a feed network; and a device configured to transmit or receive electromagnetic signals via the waveguide and the antenna.

Example 12: The system of Example 11, the system further comprising: a second metal layer defining a conductive plane; and a substrate layer having two sides of the substrate layer, the first metal layer positioned adjacent to a first side of the substrate layer and the second metal layer positioned adjacent to a second side of the substrate layer.

Example 13: The system of Example 11, wherein: the first branch further comprises a first pair of dipole elements, a first dipole element of the first pair of dipole elements positioned at an end of and generally orthogonal to the first arm of the first branch, and a second dipole element of the first pair of dipole elements positioned at an end of and generally orthogonal to the second arm of the first branch.

Example 14: The system of Example 13, wherein: the second branch further comprises a second pair of dipole elements, a first dipole element of the second pair of dipole elements positioned at an end of and generally orthogonal to the third arm of the second branch, and a second dipole element of the second pair of dipole elements positioned at an end of and generally orthogonal to the fourth arm of the second branch.

Example 15: The system of Example 14, wherein: the first branch further comprises a plurality of pairs of dipole elements, each pair of dipole elements on the first branch separated from another pair of dipole elements on the first branch by approximately one-half of a wavelength of an operating frequency of the antenna.

Example 16: The system of Example 15, wherein: the second branch further comprises a plurality of pairs of dipole elements, each pair of dipole elements on the second branch separated from another pair of dipole elements on the second branch by approximately one-half of a wavelength of an operating frequency of the antenna.

Example 17: The system of Example 11, wherein the system is a vehicle, the device is a radar system, and the feed network includes a waveguide with an end feed.

Example 18: The system of Example 11, wherein the system is a vehicle, the device is a radar system, and the feed network includes an E-plane waveguide.

Example 19: The system of Example 11, wherein the system is a vehicle, the device is a radar system, and the feed network includes an H-plane waveguide.

Example 20: The system of Example 11, wherein the system is a vehicle, the device is a radar system, and the feed network includes a microstrip line.

CONCLUSION

Although implementations of techniques for, and apparatuses enabling, a twin line fed dipole array antenna have been described in language specific to features and/or methods, it is to be understood that the subject of the appended claims is not necessarily limited to the specific features or methods described. Rather, the specific features and methods are disclosed as example implementations enabling a twin line fed dipole array antenna.

What is claimed is:

1. An apparatus comprising:

a twin line fed dipole array antenna, the antenna comprising:

a first metal layer defining a transmission line configured to receive electromagnetic energy as input, the transmission line having a lateral axis and at least:

a first branch comprising a first arm and a second arm parallel to the first arm, each of the first arm and the second arm being orthogonal to and positioned on a first side of the lateral axis; and three or more first dipoles, each first dipole comprising a pair of dipole elements, a first dipole element of each first dipole extending orthogonally from the first arm and a second dipole element of each first dipole extending orthogonally from the second arm, each first and second dipole element extending away from a longitudinal axis of the first branch; and a second branch comprising a third arm and a fourth arm parallel to the third arm, each of the third arm and the fourth arm being orthogonal to and positioned on a second side of the lateral axis that is opposite the first side of the lateral axis; and three or more second dipoles, each second dipole comprising a pair of dipole elements, a third dipole element of each second dipole extending orthogonally from the third arm and a fourth dipole element of each second dipole extending orthogonally from the fourth arm, each third and fourth dipole element extending away from the longitudinal axis of the second branch.

2. The apparatus of claim 1, the apparatus further comprising:

a second metal layer defining a conductive plane; and a substrate layer having two sides of the substrate layer, the first metal layer positioned adjacent to a first side of the substrate layer and the second metal layer positioned adjacent to a second side of the substrate layer.

3. The apparatus of claim 2, wherein the first metal layer, the second metal layer, and the substrate layer are layers of a printed circuit board.

4. The apparatus of claim 2, the apparatus further comprising:

a feed slot positioned in and centered on the conductive plane to align with the lateral axis, the feed slot configured to excite the transmission line.

5. The feed slot apparatus of claim 4, wherein the feed slot is excited by a microstrip line, a waveguide end, a waveguide, or a substrate integrated waveguide.

6. The apparatus of claim 1, wherein:

each pair of dipole elements on the first branch separated from another pair of dipole elements on the first branch by approximately one-half of a wavelength of an operating frequency of the antenna.

7. The apparatus of claim 1, wherein:

each pair of dipole elements on the second branch separated from another pair of dipole elements on the second branch by approximately one-half of a wavelength of an operating frequency of the antenna.

8. The apparatus of claim 1, wherein:

the antenna is configured to radiate energy at a low cross-polarization level.

9. The antenna of claim 1, wherein:

each dipole element has an approximately rectangular shape, bowtie shape, circular shape, oval shape, C shape, or L shape.

10. A system comprising:

an antenna, the antenna comprising:

a first metal layer defining a transmission line configured to receive electromagnetic energy as input, the transmission line having a lateral axis and at least:

a first branch comprising:

a first arm and a second arm parallel to the first arm, each of the first arm and the second arm being orthogonal to and positioned on a first side of the lateral axis; and three or more first dipoles, each first dipole comprising a pair of dipole elements, a first dipole element of each first dipole extending orthogonally from the first arm and a second dipole element of each first dipole extending orthogonally from the second arm, each first and second dipole element extending away from a longitudinal axis of the first branch; and a second branch comprising:

a third arm and a fourth arm parallel to the third arm, each of the third arm and the fourth arm being orthogonal to and positioned on a second side of the lateral axis that is opposite the first side of the lateral axis; and three or more second dipoles, each second dipole comprising a pair of dipole elements, a third dipole element of each second dipole extending orthogonally from the third arm and a fourth dipole element of each second dipole extending orthogonally from the fourth arm, each third and fourth dipole element extending away from the longitudinal axis of the second branch; and a feed network; and a device configured to transmit or receive electromagnetic signals via the antenna.

11. The system of claim 10, the system further comprising:

a second metal layer defining a conductive plane; and a substrate layer having two sides of the substrate layer, the first metal layer positioned adjacent to a first side of the substrate layer and the second metal layer positioned adjacent to a second side of the substrate layer.

12. The system of claim 11 further comprising:

a feed slot positioned in and centered on the conductive plane to align with the lateral axis, the feed slot configured to excite the transmission line.

13. The system of claim 12, wherein the feed slot is excited by a microstrip line, a waveguide end, a waveguide, or a substrate integrated waveguide.

14. The system of claim 10, wherein:

each pair of dipole elements on the first branch separated from another pair of dipole elements on the first branch by approximately one-half of a wavelength of an operating frequency of the antenna.

15. The system of claim 10, wherein:

each pair of dipole elements on the second branch separated from another pair of dipole elements on the second branch by approximately one-half of a wavelength of an operating frequency of the antenna.

16. The system of claim 10, wherein:

the system is a vehicle;

the device comprises a radar system; and the feed network includes a waveguide with an end feed.

17. The system of claim 10, wherein:

the system is a vehicle;

the device comprises a radar system; and the feed network includes an E-plane waveguide.

18. The system of claim 10, wherein:

the system is a vehicle;

the device comprises a radar system; and the feed network includes an H-plane waveguide.

19. The system of claim 10, wherein:

the system is a vehicle;

the device comprises a radar system; and the feed network includes a microstrip line.

20. The system of claim 10, wherein each dipole element has an approximately rectangular shape, bowtie shape, circular shape, oval shape, C shape, or L shape.

* * * * *